US007775253B1

(12) United States Patent
Milligan

(10) Patent No.: US 7,775,253 B1
(45) Date of Patent: Aug. 17, 2010

(54) SECURITY SHUTTERS

(76) Inventor: Loren Milligan, 102 N. Main, Baxter, IA (US) 50028

( * ) Notice: Subject to any disclaimer, the term of this patent is extended or adjusted under 35 U.S.C. 154(b) by 466 days.

(21) Appl. No.: 11/373,410

(22) Filed: Mar. 10, 2006

(51) Int. Cl.
*E06B 3/48* (2006.01)

(52) U.S. Cl. ..... 160/117; 160/130

(58) Field of Classification Search ..... 160/104, 160/117, 210, 233, 234; 292/88, 89, DIG. 20; 49/383, 449, 74.1, 394, 38; 70/14, 89–91, 70/101, 94, 203, DIG. 14, DIG. 65, DIG. 66; 454/196

See application file for complete search history.

(56) References Cited

U.S. PATENT DOCUMENTS 13,300 A * 7/1855 Chase ..... 52/656.7
671,756 A * 4/1901 Chase ..... 49/38
2,536,941 A * 1/1951 Jones ..... 292/288
3,059,952 A * 10/1962 Wittman et al. ..... 292/288
3,570,283 A * 3/1971 Males ..... 70/14
4,033,073 A * 7/1977 Bogan ..... 49/38
7,422,047 B1 * 9/2008 McDonald ..... 160/229.1
2004/0140062 A1 * 7/2004 Lee ..... 160/117
2004/0172990 A1 * 9/2004 O'Rouke ..... 70/58
2006/0027345 A1 * 2/2006 Briscoe et al. ..... 160/213

* cited by examiner

*Primary Examiner*—Katherine W Mitchell
*Assistant Examiner*—Jeremy C Ramsey
(74) *Attorney, Agent, or Firm*—Camille L. Urban; G. Brian Pingel

(57) ABSTRACT

A security shutter having two units. Each unit has two panels hingedly connected to one another with one panel permanently affixed to a structure near one side of an opening. When closed, the panels of each unit cover the opening, and a securing mechanism is used to secure their positions. Further, each panel includes a plurality of spaced apart slats aligned in an alternating pattern relative to the plurality of slats on the adjacent panel such that, when the shutter is not in use and one panel overlays the other against the structure, the shutter unit appears as a traditional panel without spacing between slats.

5 Claims, 5 Drawing Sheets

SECURITY SHUTTERS

BACKGROUND OF THE INVENTION

1. Field of the Invention

The present invention relates generally to shutters mounted on the exterior of a structure used to cover windows or other openings and more specifically to security shutters for prevention of entry by intruders.

2. Description of Related Art

Every year, weather causes millions of dollars worth of damage to the interiors of certain structures. Much of this damage can be minimized if windows and other exterior openings can be effectively and temporarily blocked as needed. In response to this need, a large variety of shutters and shuttering devices have been developed to be moved into place and secured over the opening as needed for inclement weather.

Every year, intruders burgle empty houses. Rich targets for theft are structures wherein the inhabitants are absent, especially if the absence is for longer periods of time. Although door locks can be effectively used to deter entry through doors, windows on lower floors often offer an easy ingress and egress for would-be burglars.

Some of the weather shutters can double as security shutters, however, these are often made to be attached to the structure over the opening only when needed. They are not decorative or appealing to the eye. Mostly, they are of a solid planar construction so as to repel weather. Those with security as a secondary objective often include fairly complex locking systems.

It is therefore one object of the present invention to provide a shutter-type security device that could be mounted on the exterior of a structure. A second object of the present invention is to provide a shuttering device that is simple to close over the window or opening and simple to lock. A third objective was to provide a shuttering device that was sturdy enough to deter theft and intrusion. The fourth objective was to accomplish the foregoing while still appearing as an attractive shutter when not in use. The fifth and final objective was to position connecting hardware and securing mechanisms so as to be simple to install and use, but difficult to remove by an intruder.

SUMMARY OF THE INVENTION

The present invention comprises two shutter units each having at least two panels. The first panel is generally permanently associated with the structure on one side of an opening such as a window or doorway, and hingedly associated with the second panel. Each second panel has an outer frame having at least one vertical support. Each panel includes horizontally oriented and spaced apart slats made of steel or other strong material so that the panels appear to be louvers and the spacing does not allow entrance of an intruder.

When each of the shutter units is closed across the window or other opening, the vertical support on the second panel of the first shutter unit is secured to the vertical support on the second panel of the second shutter unit such that an intruder may not enter on any side of the shutter or through the slats. The spacing and positioning of the slats on the first panel relative to the second panel alternate such that, when the shutters are not in use and the second panel is folded back to lie directly over the first panel, the whole appearance is that of a traditional louvered shutter having no spaces between the slats. One advantage of this design is that the slats allow heavy components to be used for strength without overburdening the attachments and, when opened, provide a traditional look of shutters rather than a solid façade or other unexpected and unattractive appearance.

The security shutters are preferably made of steel components. The spacing between the slats is preferably narrow enough to keep human hands out, however, such narrow spacing is not necessary for the shutters to function if even at a somewhat lower level of security. The hinges between the first and second panels are positioned on the backside of the shutter unit and inaccessible to an intruder when the shutters are closed. Means to pivotally associate the first panel with the structure are secured to the structure in a manner resistant to tampering. For example, hinges can be secured using non-reversible screws.

In a modified embodiment, a flexible shade element may be mounted on the backside of the shutter to assist in blocking the sun from penetrating the windows or interior curtains. This shade is preferably attached or detached as needed rather than made an integral part of the shutter which would detract from its appearance. Preferably, a frame is included in which shade material is mounted; the frame, then, is secured to the backside of the shutter after it is positioned across the window.

Upon closing of the shutter units over the opening, the preferred embodiment includes at least one securing mechanism. Each mechanism includes a bracket and a locking device. The bracket is designed to snugly fit substantially around the vertical support of the second panel on the first unit and the vertical support of the second panel of the second unit and includes a portion that protrudes between the shutter units to the backside thereof. The bracket is secured in place by a pin inserted in a predrilled hole on the front side of the support on the first unit and a second pin inserted in a second predrilled hole on the front side of the support on the second unit and the locking device is positioned on the backside of the vertical supports and associated with the protruding portion of the mechanism. Although the preferred embodiment includes a predrilled hole on the front side, it is conceivable that more than one hole and pin arrangement for each shutter unit per securing device could be used and that the position of the hole could be anywhere on the vertical support that is accessible for locking purposes. The pins can be spring-loaded. The locking device simply prevents the bracket from being disengaged from the pins by providing a physical block to movement of the bracket. The locking device is positioned on the backside of the shutters and sized and positioned so as not to be accessible by tool or hand from the front side. The preferred embodiment utilizes three securing mechanisms vertically spaced apart.

In operation, the shutter units are unfolded across the window or other opening. Then, the pins of each of the securing mechanisms are aligned with respective holes. Next, the operator goes inside the structure, opens the window or door from within, secures the locking device in place on the backside of the shutter, and closes the window or door. If a shade is to be installed, it may be mounted to the backside of the shutter prior to securing the units together. The purpose of the security shutters is to provide security in homes or structures that are unoccupied while providing the appearance of traditional shutters when not in use.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
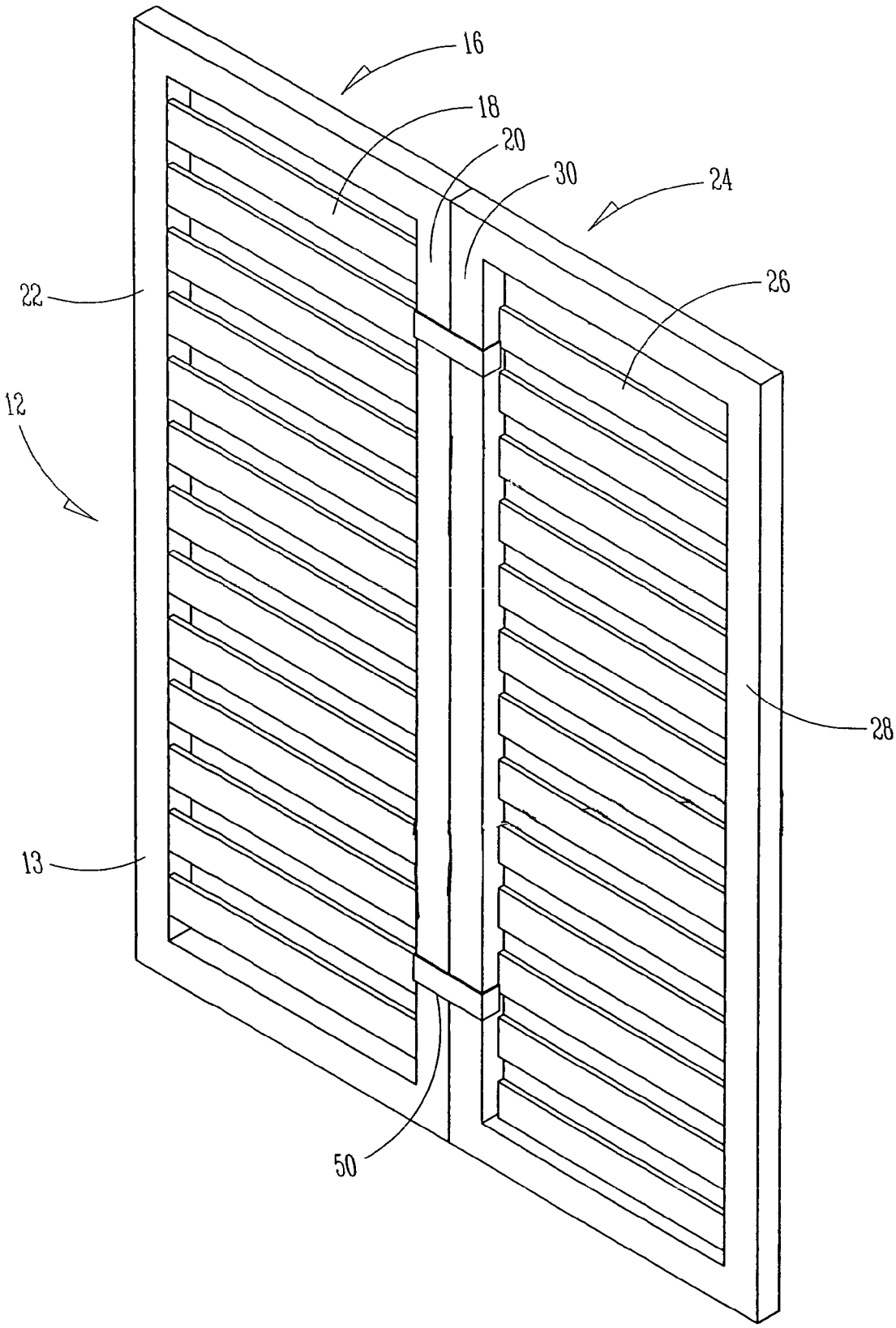
FIG. 1 is a perspective view of a first shutter unit of the security shutters when closed over an opening.
Figure 2:
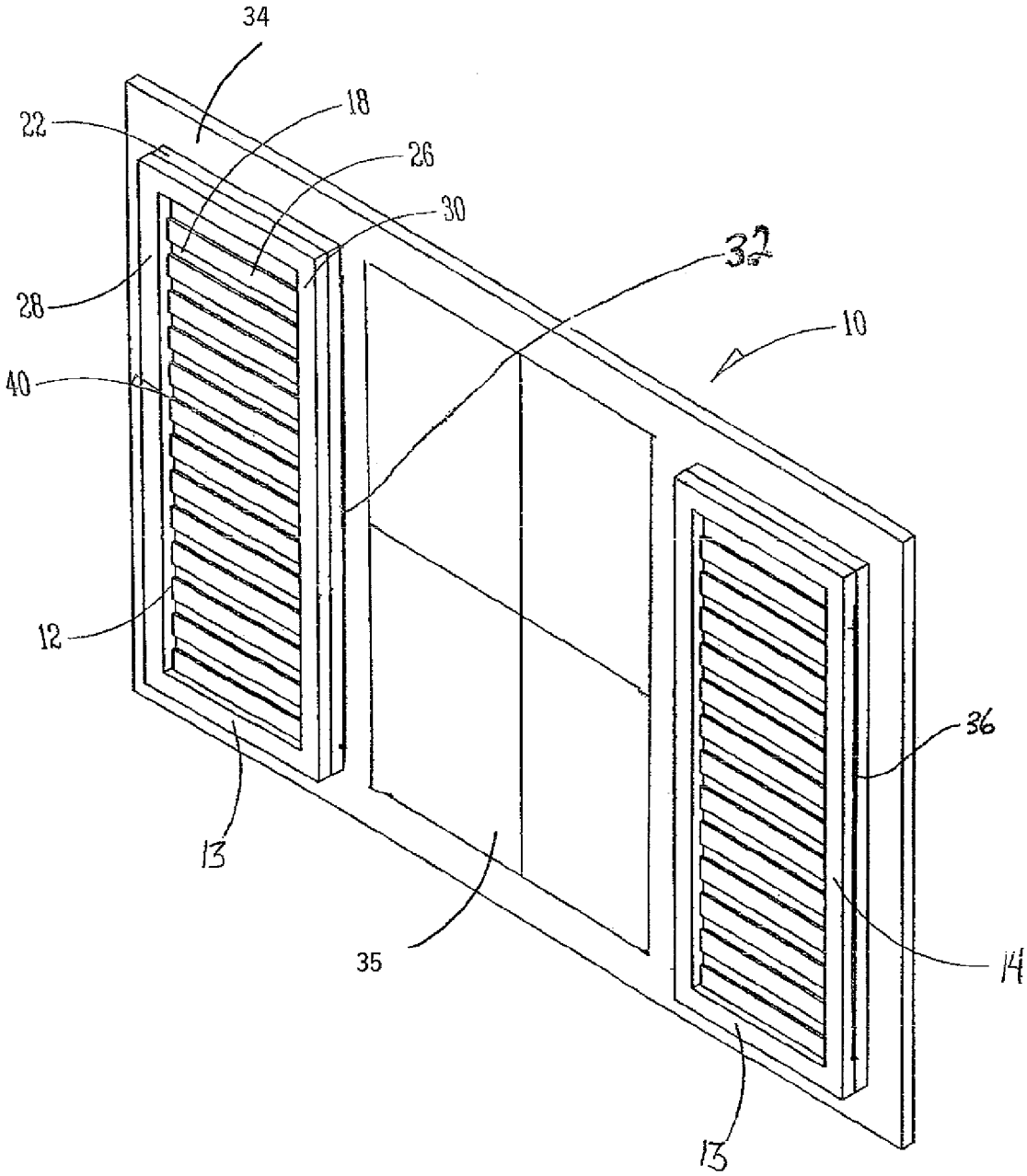
FIG. 2 is a perspective view of the security shutters when opened.

The present invention comprising a security shutter unit is shown as 10 in FIGS. 1 and 2. The security shutter comprises a first shutter unit 12 and a second shutter unit 14 each having a front 13 and a backside 15. Each shutter unit 12 and 14 has a first panel 16 with a first plurality of horizontal spaced apart slats 18, a first vertical support 20, and a first vertical side 22 and a second panel 24 with a second plurality of horizontal spaced apart slats 26, a second vertical support 28, and a second opposing side 30. Said first panel 16 further comprises means for attaching 32 said first opposing side 22 to a building structure 34 and means for hingedly associating 36 said first vertical support 20 to said second opposing side 30 of the second panel 24. Preferably, means for attaching 32 provide pivotal action relative to the structure and are located on said backside of each said shutter unit. In the preferred embodiment, means for attaching 32 and means for hingedly associating 36 each comprise a piano hinge positioned so as to be generally inaccessible from the front when the shutter units are in a closed position. Other pivoting and hinging mechanisms known in the art can offer similar advantages and functions.

Referring now to FIG. 2, when each said shutter unit 12 and 14 is open, said second panel 24 is folded in front of said first panel 16. Said first plurality of horizontal spaced apart slats 18 and said second plurality of horizontal spaced apart slats 26 are arranged in an alternating pattern 40 so that each of said first plurality of slats is in a horizontal plane corresponding with a space between two of said second plurality of slats. This arrangement provides the appearance of a traditional shutter with slats that are not spaced apart.

Figure 3:
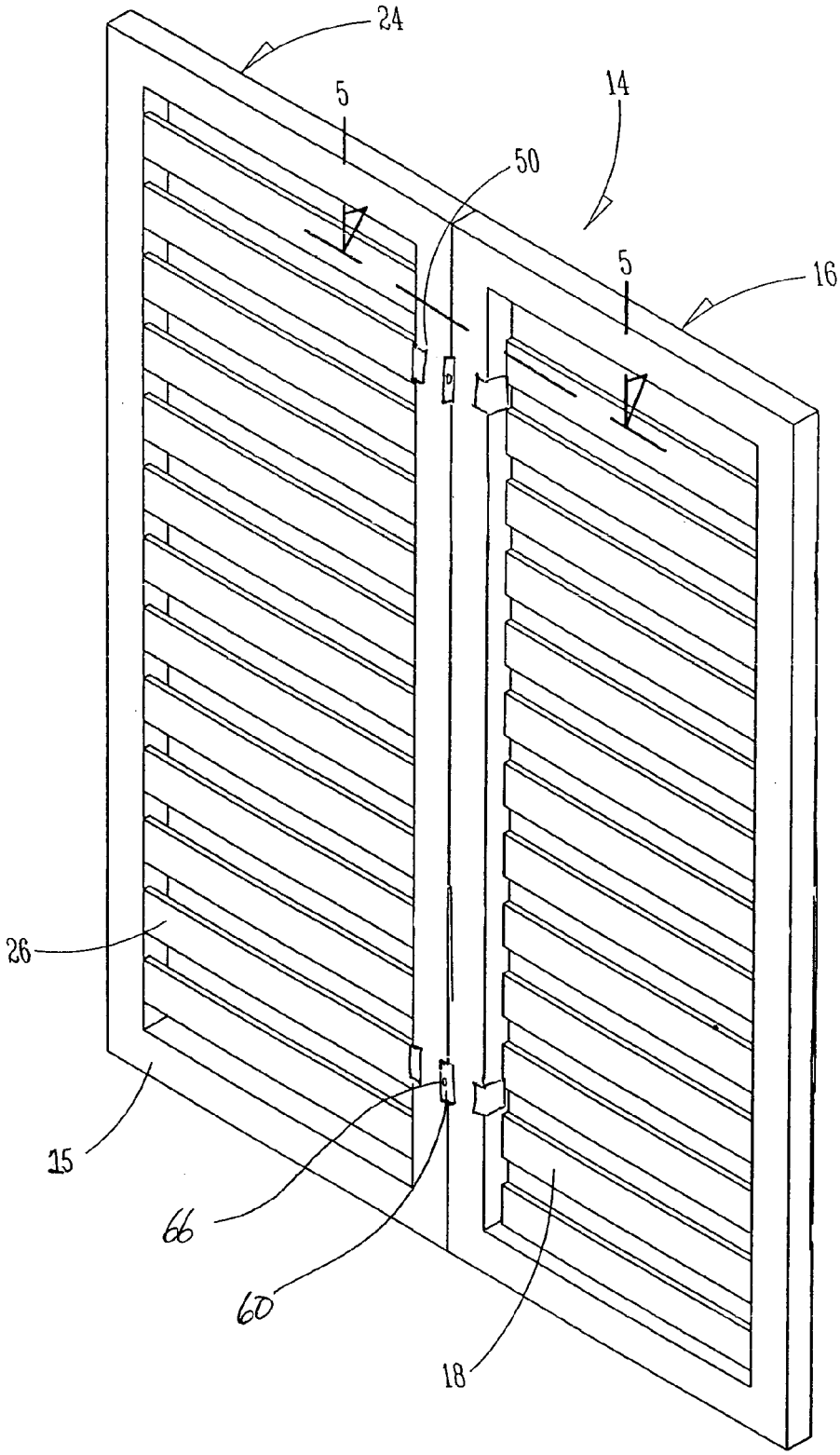
FIG. 3 is a perspective view of the back side of the closed shutter units.
Figure 4:
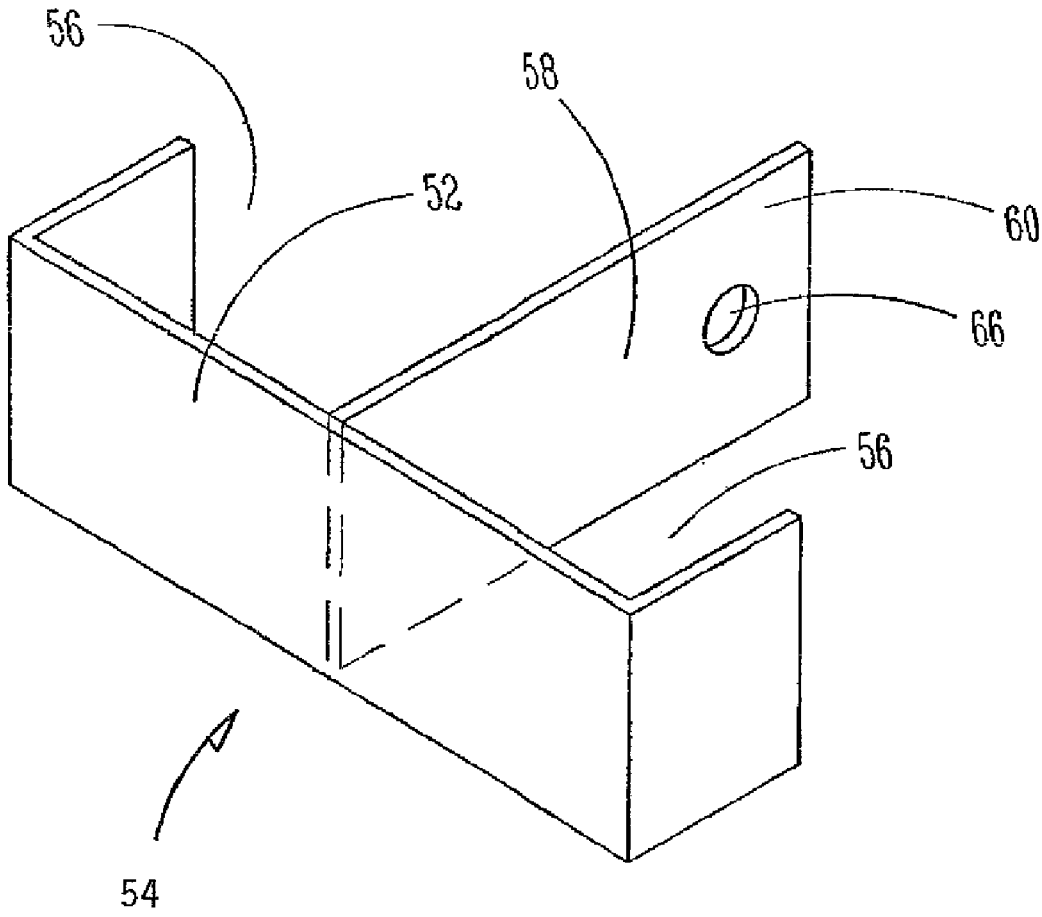
FIG. 4. is a perspective view of the securing mechanism of the present invention.
Figure 5:
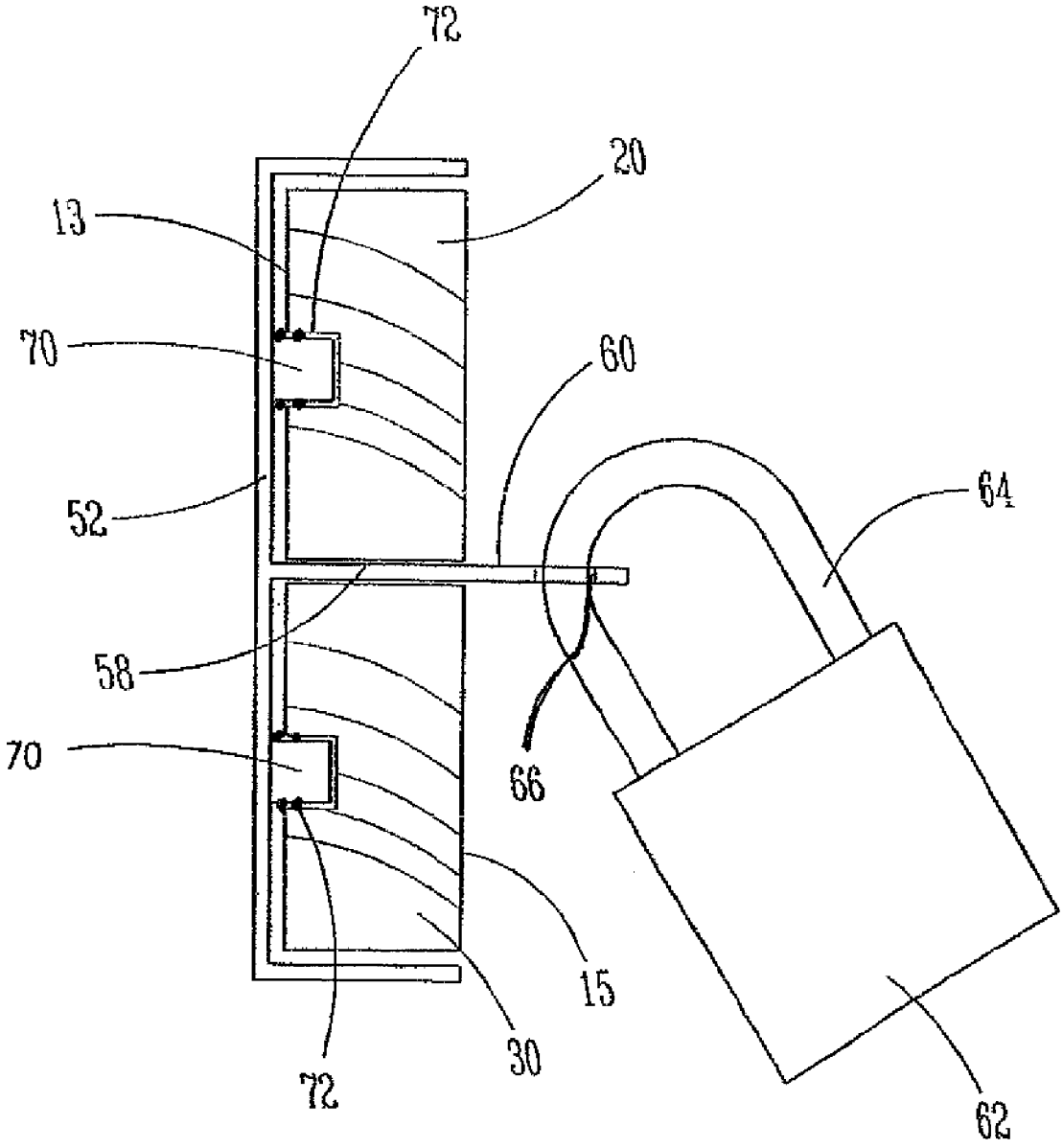
FIG. 5 is a cross section of FIG. 3 along line 5-5 showing the means for securing the security shutters.

When the shutter units 12 and 14 are closed across an opening 35, means for securing 50 said first shutter unit 12 to said second shutter unit 14 are provided (see FIGS. 3-5). Said means 50 is shown best in FIG. 4 and comprises at least one securing mechanism 52 having a bracket 54 with at least two generally parallel channels 56 and a tab 58 separating the channels 56 and having an extending portion 60. The channels 56 may be of any shape but, preferably, are shaped complementarily to said second vertical support 28 of said second panel 24 on each shutter unit 12 and 14. Said securing mechanism 52 further comprises a locking device 62 (see FIG. 5). In the preferred embodiment, the locking device 62 includes a shackle 64 and the tab 58 includes an opening 66 for receiving said shackle 64.

In the preferred embodiment, means for securing 50 further comprise at least one pin 70 and one hole 72 into which said pin 70 fits for positioning said bracket 54 relative to said first shutter unit 12 and said second shutter unit 14. In addition, said tab 58 extends from the front 13 to the backside 15 of said shutter units.

The method for using these shutters is fairly simple. When the security shutter is opened, each shutter unit is folded against the building structure with its second panel overlaying the first panel to provide the appearance of a traditional shutter. To close the security shutter, the operator unfolds each shutter unit across the opening such that the second vertical support of the first shutter unit is adjacent the second vertical support of the second shutter unit. Next, each bracket is placed on the front of each shutter unit such that one second vertical support is partially surrounded by one channel and the tab is inserted therebetween with the extending portion on the backside of the shutter units. The operator then goes inside the building structure and opens the window or door over which the shutter is opened so that the backside of the shutter units is accessible. The locking device is then secured to the extending portion of the tab on the backside of the shutter units.

In the preferred embodiment, the bracket's position is secured by insertion of the pin into the hole or by insertion of multiple pins into multiple holes. The pin may be mounted on the vertical support and the hole in the bracket or vice versa. The shackle of the locking device is inserted through the opening in the tab and secured. The opening in the tab is positioned such that, upon insertion of the shackle, forward, aft, vertical, and horizontal movement of the bracket is restricted to the degree that the pins may not be disengaged.

Thus, the present invention has been described in an illustrative manner. It is to be understood that the terminology that has been used is intended to be in the nature of words of description rather than of limitation.

Many modifications and variations of the present invention are possible in light of the above teachings. For example, other mechanical means known in the art may be employed to secure the shutter units to the building, different locking mechanisms might be employed, material used to construct the shutters may be alternatively light, yet high tensile strength. Therefore, within the scope of the appended claims, the present invention may be practiced otherwise than as specifically described.

What I claim is:

1. A security shutter comprising a) at least two shutter units each having a backside, a front, a first panel with a first vertical support and an opposing side and a second panel with a second vertical support and an opposing side;

b) wherein each said first panel includes a plurality of $1^{st}$ slats with a respective $1^{st}$ open space between every 2 adjacent $1^{st}$ slats, each $1^{st}$ slat having a horizontally-oriented $1^{st}$ longitudinal axis and each said second panel includes a plurality of $2^{nd}$ slats with a respective $2^{nd}$ open space between every 2 adjacent $2^{nd}$ slats, each $2^{nd}$ slat having a horizontally-oriented 2nd longitudinal axis parallel to every $1^{st}$ longitudinal axis, the position of each of the $1^{st}$ plurality of slats is fixed relative to said first vertical support and the position of each of the $2^{nd}$ plurality of slats is fixed relative to said second vertical support such that when said $2^{nd}$ panel overlays said first panel, each respective $1^{st}$ longitudinal axis lies in a respective $2^{nd}$ open space, and each respective $2^{nd}$ longitudinal axis lies in a respective $1^{st}$ open space, said $1^{st}$ open spaces located in a plane located behind said $2^{nd}$ open spaces;

c) a first piano hinge for attaching said opposing side of said first panel of each said unit to a building structure wherein said first piano hinge runs substantially the entire length of said first panel;

d) a second piano hinge for associating the vertical support of said first panel of each said shutter unit with the opposing side of said second panel of each said shutter unit wherein said second piano hinge runs substantially the entire length of said first and second panels;

e) means for securing said first shutter unit and said second shutter unit together comprising a bracket and a locking device; and f) said bracket comprising a first channel complementary to and partially surrounding the vertical support of said second panel in said first shutter unit, a second channel complementary to and partially surrounding the vertical support of said second panel in said second shutter unit, and a tab extending between and beyond said first and second channels to the backside of said shutter units.

2. The security shutter of claim 1 wherein said means for securing further comprises at least one pin and at least one complementary hole for said pin to position said bracket relative to each of said vertical supports.

3. The security shutter of claim 1 or 2 wherein said locking device comprises a shank and said tab comprises an opening through which said shank is inserted and secured on said back side of said shutter units.

4. The security shutter of claim 3 wherein said opening in said tab is positioned such that when said locking device is engaged, movement of said means for securing is restricted.

5. The security shutter of claim 2 wherein said pins are springloaded.

* * * * *